United States Patent [19]

Chang

[11] Patent Number: 4,872,775

[45] Date of Patent: Oct. 10, 1989

[54] NOTE PAPER-HOLDING PEN

[76] Inventor: Shi-Lung Chang, P.O. Box 10160, Taipei, Taiwan

[21] Appl. No.: 141,513

[22] Filed: Jan. 6, 1988

Related U.S. Application Data

[63] Continuation-in-part of Ser. No. 66,221, Jun. 24, 1987, abandoned.

[51] Int. Cl.[4] ..... B43K 29/12

[52] U.S. Cl. ..... 401/52; 401/195; 242/55.53

[58] Field of Search ..... 401/52, 195; 242/55, 242/53, 173

[56] References Cited

U.S. PATENT DOCUMENTS

| | | | |
|---|---|---|---|
| 297,396 | 4/1884 | Hickisson et al. | 401/52 X |
| 1,170,744 | 2/1916 | Fesler | 401/175 |
| 1,212,020 | 1/1917 | Contant, Jr. | 242/55.53 |
| 1,266,299 | 5/1918 | Moore | 401/52 |
| 1,540,876 | 6/1925 | Dwyer | 242/55.53 |
| 1,759,596 | 5/1930 | Steudte | 401/195 X |
| 1,950,324 | 3/1934 | Powers | 401/175 X |
| 2,073,719 | 3/1937 | Ross | 242/55.53 |
| 2,330,117 | 9/1943 | Feinberg | 242/55.53 |
| 2,509,843 | 5/1950 | Russell | 242/55.53 |
| 2,512,168 | 6/1950 | Moore | 401/52 X |
| 2,732,817 | 1/1956 | Robinson | 242/173 |
| 2,857,046 | 10/1958 | Klein | 242/55.53 |
| 3,156,356 | 11/1964 | McConnell | 242/55.53 X |
| 4,135,831 | 1/1979 | Reitknecht | 401/175 |
| 4,239,164 | 12/1980 | Barnsbee et al. | 242/55.53 |

FOREIGN PATENT DOCUMENTS

| | | | |
|---|---|---|---|
| 477818 | 5/1929 | Fed. Rep. of Germany | 401/52 |
| 451884 | 11/1937 | Fed. Rep. of Germany | 401/52 |
| 1043580 | 11/1953 | France | 401/195 |
| 1332174 | 10/1973 | United Kingdom | 401/195 |

*Primary Examiner*—Steven A. Bratlie

[57] ABSTRACT

A slip-holding pen includes a slip reel, having a paper roll with its two opposite ends coated and bonded by an adhesive, rotatably mounted in a penholder and a rotating knob clickingly rotating the slip reel to reel off the slip paper as originally wound on the reel through a longitudinal slit which is formed on the penholder having acute wedges formed at the slit to tear the adhesive-bonded slip paper, so that the knob can be rotated to easily unroll the paper slip directly from the pen for an immediate writing use.

4 Claims, 2 Drawing Sheets

NOTE PAPER-HOLDING PEN

BACKGROUND OF THE INVENTION

This application is a continuation-in-part of original application filed on June 24, 1987 by the same inventor with a Ser. No. of 07/066,221 now abandoned. Original application discloses a slip-holding pen having a slip roll reeled in a pen holder and a rotating knob clickingly rotating the slip roll to unroll a paper slip for writing use. However, the paper rolled on a slip reel may be loosened during the unwinding rotation of the knob to thereby influence the smooth supply of the rolled paper slip.

R. C. Moore taught a paper roll in his U.S. Pat. No. 2,512,168 having an adhesive applied to two opposite ends of a paper roll to bind the successive convolutions of the web firmly in place to prevent its loosening. However, the paper must be torn from the roll between the dotted lines (2) and projected through a slot of the tube to still remain a residual upper end portion (1*c*) and a lower end portion (1*b*) on the core (6). It means that the paper can not be easily and conveniently released from the tube (7) and must be forcibly torn by a user's pulling force. Meanwhile, the residual paper portions (1*c*, 1*b*) are still remained on the core (6) to reduce the useful writing area of the paper as torn outwardly through the slot (18).

When a paper is cut along the slot (18), there is no marginal paper portion protruding beyond the slot (18) for the pulling by a user's hand for next use. It is very difficult to withdraw the paper which may be retracted inwardly from the slot to cause its inconvenience for use.

The present inventor has found the drawbacks of conventional paper rolls and invented the present slip-holding pen.

SUMMARY OF THE INVENTION

The object of the present invention is to provide a slip-holding pen including a slip reel having a slip roll rolled on the reel rotatably mounted in a pen holder and a rotating knob clickingly rotating the slip reel to unroll the slip paper through a longitudinal slit formed in the holder for writing purpose, wherein a wedge portion is formed at the longitudinal slit for tearing the rolled paper as bonded on the roll by adhesive for easier tearing and unrolling of the slip paper.

DETAILED DESCRIPTION

Figure 1:
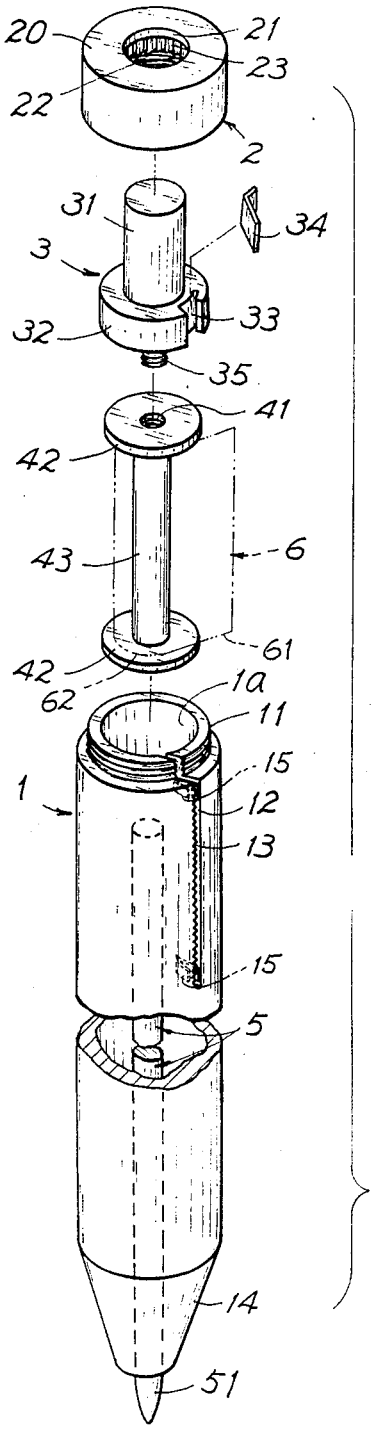
FIG. 1 is a perspective illustration showing all elements of the present invention.
Figure 2:
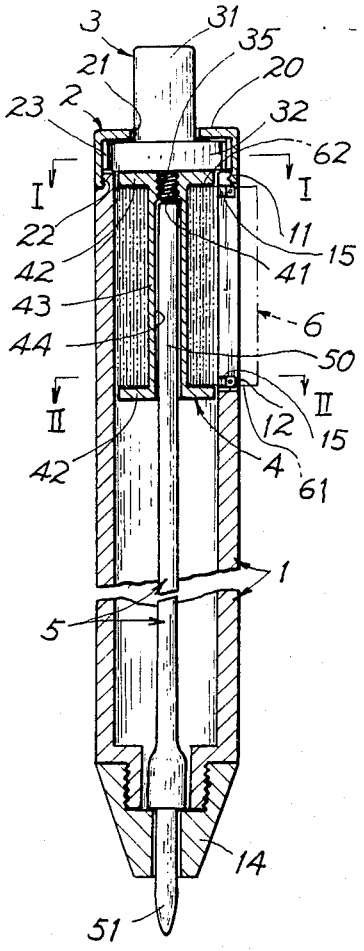
FIG. 2 is a sectional elevation of the present invention.
Figure 3:
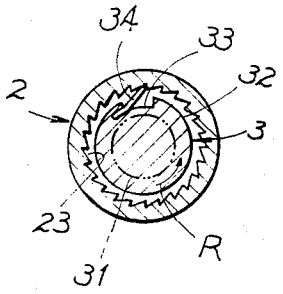
FIG. 3 is a cross-sectional drawing of the present invention as viewed from I—I direction of FIG. 2.

As shown in FIGS. 1–4, the present invention comprises: a penholder 1, an upper cap 2, a rotating knob 3, a slip reel 4, a central stick 5 selected from a pencil lead and an inner ink reservoir of a ball pen and a slip roll 6 operatively wound on or reeled off the slip reel 4 with two opposite ends 61 of the roll 6 coated by adhesive 62.

The penholder 1 is formed as a generally longitudinal cylinder having an inner hollow bore portion 1*a* and having a male-threaded portion 11 formed on its top end, a longitudinal slit 12 formed in an upper portion of the penholder 1, and a lower cap 14 fixed on the lower end of the holder limiting a lower end of the central stick 5. The longitudinal slit 12 includes: a pair of longitudinal edges 121, 122 generally tangential to the circumference of the bore portion 1*a* (FIG. 4), a pair of wedge portions 15 respectively formed on two opposite ends on a first longitudinal edge 121 approximate and corresponding to two opposite ends 61 of the slip roll and a saw-toothed portion 13 longitudinally formed along an acute-angle edge at the outermost end of a second longitudinal edge 122.

The upper cap 2 includes an upper round cover 20 having a central hole 21, a female-threaded portion 22 formed on its lower perimeter engageable with the male-threaded portion 11 of the penholder 1, and a plurality of ratchet teeth 23 circumferentially formed on a cylindrical wall inside the cap 2.

The rotating knob 3 includes a stem portion 31, a round disk 32 formed on a lower portion of the stem 31 having a recess 33 for inserting a spring pawl 34 therein, and a male-threaded rod portion 35 protruding downwardly from the disk 32. The round disk 32 with its spring pawl 34 is clickingly rotatably engageable with the ratchet teeth 23 inside the cap 2 to allow a single-direction rotation of the knob. The stem portion 31 is rotatably mounted in the central hole 21 of the cap 2.

The slip reel 4 includes a central axle 43 having a central hole 44 rotatably engageable with an upper stick portion 50 of the central stick 5, two round flanges 42 respectively disposed on both upper and lower ends of the axle 43 rotatably mounted in the bore portion 1*a*, and a female-threaded hole 41 formed in the upper flange 42 engageable with the male-threaded portion 35 of the rotating knob 3 for securing the reel 4 to the knob 3.

The slip roll 6 is a rolled paper strip originally wound on the axle 43 of the reel 4 having an adhesive coated on two opposite ends 61 of the roll 6 to prevent from its loosening. The length of the longitudinal slit 12 should be slightly larger than the width of the slip roll 6. After securing the reel 4 on the knob 3, the slip roll 6 should be suitably positioned to correspond the slit 12 so that the paper slip 6 can be reeled off through the slit 12.

When it is intended to use the paper slip 6 reeled in the penholder 1, the stem portion 31 is rotated in direction R to rotate the reel 4 to reel off the paper slip 6 outwardly through the slit 12 to a desired extent and the paper is then cut off against the saw-toothed portion 13 of the slit 12. During the rotation of knob 3 in direction R, the spring pawl 34 is clickingly slipping away from each ratchet tooth to drive the reel 4. However, once the slip is drawn to the desired length, the knob 3 is no more rotated and the pawl will be resiliently engaged with the ratchet tooth 23 to brake the rotation of the reel 4 and to stop the unwanted releasing of the paper slip 6.

Figure 6:
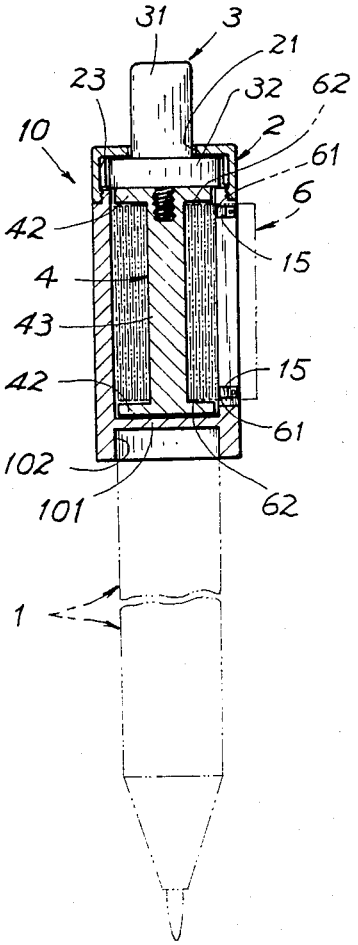
FIG. 6 shows another preferred embodiment of the present invention.

Another preferred embodiment of the present invention is modified as a slip-holding device as shown in FIG. 6, which comprises: a cylindrical jacket 10 having a longitudinal slit 12 formed in the jacket and a hollow bore portion formed inside the jacket, an upper cap 2 having a plurality of ratchet teeth 23 circumferentially formed on the inside wall of the cap and having a central hole 21, a rotating knob 3 having a stem 31 protruding through the central hole 21 and a round disk 32 with a spring pawl 34 clickingly engageable with the ratchet teeth 23 of the cap, a slip reel 4 secured to the knob 3 and having two circular flanges rotatably mounted within the hollow bore portion of the jacket 10 and a slip roll 6 having its two opposite ends 61 coated by an adhesive wound on the reel 4 adapted to be operatively reeled off through the slit 12 upon the rotation of the knob 3. The jacket 10 is formed with a socket 102 under its bottom plate portion 101, so that the socket 10 may be mounted on a penholder of a conventional pen or pencil. The jacket 10 may be made of rubber so that the socket 102 may be snugly mounted on the irregular penholder of a traditional pen or pencil. By the way, the present invention can be optionally mounted on any other type of traditional pen or pencil to enrich its mutiple uses such as for writing use and for supplying paper slip.

The adhesive 62 used in this invention to coat on two opposite ends 61 of the slip roll 6 may be selected from: a polyvinyl acetate, an acrylics based on acrylate and methacrylate polymers, epoxy resins, isocyanates, and other suitable adhesives. A preferable adhesive such as polyvinyl acetate (PVAc) as used in this invention can be diluted with water to form an aqueous solution of 50% by weight. After coating and curing of PVAc on the ends 61 of slip roll 6, a tearing strength of 0.66–1.54 $kg/cm^2$ should be applied to tear the slip paper as bonded by the adhesive. The "tearing strength" as designated herewith means a strength applied on the slip paper as actuated by the rotating knob 3 to release from the longitudinal slit 12 of this invention by overcoming the bonding strength of the adhesive bonding the convolutions of both ends 61 of the roll 6.

Hence, the adhesive used in this invention must be carefully selected to provide a suitable bonding strength to bond the ends 61 of the paper roll 6 so as to help a smooth unrolling operation of the slip roll through the slit 12 of the present invention.

Figure 5:
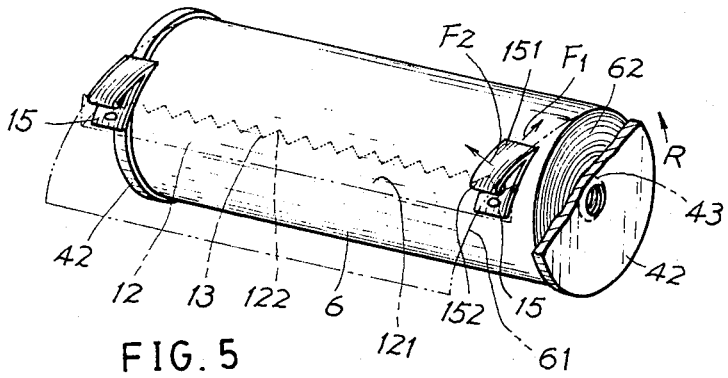
FIG. 5 is a perspective illustration showing a tearing operation of the slip roll of the present invention.
Figure 4:
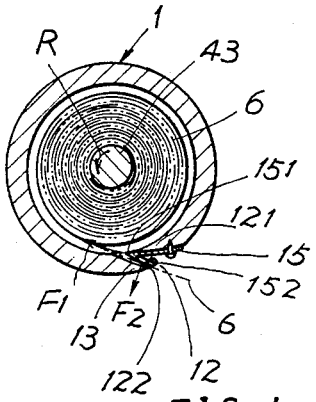
FIG. 4 is a cross-sectional drawing of the present invention as viewed from II—II direction of FIG. 2.

The pair of wedge portions 15 as mounted on the first edge 121 as shown in FIGS. 5 and 4 each includes: an acute portion 151 formed on its front end and an arcuate spring plate 152 protruding divergently and outwardly from the acute portion 151 resiliently contacting the second longitudinal edge 122 of the slit 12.

When the slip paper is unrolled and released through the slit 12 of this invention, the acute portion 151 of the wedge portion 15 pokes inwardly to tear the paper sheet from its adhesive-bonded end 61 (Force F1) and the arcuate spring plate 152 further forces the paper sheet upwardly to help tear the paper from its adhesive-bonded situation (Force F2) so that the slip paper is unrolled and released easily from the slit 12 when rotating the knob 3 in direction R as shown in FIGS. 5 and 4.

Figure 7:
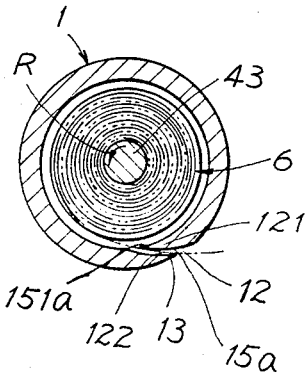
FIG. 7 shows still another preferred embodiment of the present invention.

Still another preferred embodiment of the present invention is shown in FIG. 7 wherein the aforementioned pair of wedge portions 15 are substituted with a longitudinal wedge portion 15a having a longitudinal acute end portion **151*a* directly formed on the first edge 121** for tearing the bonded slip paper as coated by adhesive.

Accordingly, this invention has the following advantages superior to a conventional paper roll:

1. Just rotating the knob 3, the slip paper can be easily unrolled through the slit 12 as the wedge portions 15 may automatically tear the adhesive-bonded paper from the slip roll 6.

2. The paper roll will not be loosened or unrolled to cause tangling or obstruction of the paper inside the penholder when unrolling the paper roll for outwardly releasing use.

3. The slip roll 6 can be easily refilled by opening the cap 2 and dismantling the knob 3 fixed on the reel 4.

4. There is no need to always protrude an outermost marginal portion of the slip paper outwardly beyond a slot for tearing or withdrawing the paper as usually found in a conventional paper roll reeled in a tube, since the paper is not torn by a user's hand and is outwardly released merely by rotating the top knob 3.

I claim:

1. A slip-holding pen comprising:

a penholder formed as a generally longitudinal cylinder having an inner hollow bore portion and having a male-threaded portion formed on a top end of said penholder, a longitudinal slit formed in an upper portion of said penholder and a lower cap fixed on a lower end of said penholder limiting a lower end of a central stick selected from a pencil lead and an inner ink reservoir of a ball pen;

an upper cap having an upper round cover formed with a central hole therein, a female-threaded portion formed in a lower perimeter of the cap engageable with the male-threaded portion of said penholder, and a plurality of ratchet teeth circumferentially formed on a cylindrical wall inside said cap; a rotating knob having a stem portion rotatably mounted in said central hole of said cap, a round disk secured to said stem portion having a recess inserted with a spring pawl therein, and a male-threaded rod portion protruding downwardly from said round disk, said round disk with said spring pawl clickingly rotatably engageable with said ratchet teeth of said cap to allow a single-direction rotation of said knob;

a slip reel including a central axle rotatably mounted on an upper stick portion of said central stick, two round flanges disposed on an upper end and a lower end of said axle rotatably mounted in the bore portion of said penholder, and a female-threaded hole formed on the upper flange engaged with said male-threaded rod portion of said knob; and a slip roll having a rolled paper strip wound on said axle of said reel, and operatively unrolled to be released through said slit in said penholder, the improvement which comprises:

said longitudinal slit includes:

a pair of longitudinal edges generally tangential to a circumferential surface of said bore portion of said pen holder, a pair of wedge portions respectively formed on two opposite ends on a first longitudinal edge of said longitudinal slit approximate and corresponding to two opposite ends of said slip roll; and said slip roll having two opposite ends of said roll coated and bonded by an adhesive, whereby upon an unwinding rotation of said knob, a slip paper may be torn from said slip roll and released through said slit.

2. A slip-holding pen according to claim 1, wherein a said wedge portion includes an acute portion formed on a front end portion of said wedge portion and an arcuate spring plate protruding divergently and outwardly from said acute portion to resiliently contact a second longitudinal edge of said longitudinal slit opposite to said first longitudinal edge of said longitudinal slit.

3. A slip-holding pen according to claim 1, wherein a said wedge portion is a longitudinal acute end portion directly formed on said first longitudinal edge of said longitudinal slit.

4. A slip-holding device comprising:

a cylindrical jacket having a hollow bore portion formed therein and a longitudinal slit formed in said jacket, a bottom plate portion formed on a lower portion of said cylindrical jacket, and a socket formed under said bottom plate portion operatively mounted on a penholder of a pen; an upper cap having a central hole, and a plurality of ratchet teeth circumferentially formed on an inside wall of said cap;

a rotating knob having a stem protruding through said central hole of said cap and a round disk with a spring pawl clickingly engageable with said ratchet teeth of said cap;

a slip reel secured to said knob and rotatably mounted in said hollow bore portion of said cylindrical jacket; and a slip roll wound on said reel and operatively reeled off through said slit upon the rotation of said knob, the improvement which comprises:

said longitudinal slit includes:

a pair of longitudinal edges generally tangential to a circumferential surface of said bore portion of said cylindrical jacket, a pair of wedge portions respectively formed on two opposite ends on a first longitudinal edge of said longitudinal slit approximate and corresponding to two opposite ends of said slip roll; and said slip roll having two opposite ends of said roll coated and bonded by an adhesive, whereby upon an unwinding rotation of said knob, a slip paper may be torn from said slip roll and released through said slit.

* * * * *